United States Patent [19]

Smith, Jr. et al.

[11] 4,205,984

[45] Jun. 3, 1980

[54] MODIFIED BRASS ALLOYS WITH IMPROVED STRESS RELAXATION RESISTANCE

[75] Inventors: Warren F. Smith, Jr., Branford; John M. Vitek, Cheshire; Eugene Shapiro, Hamden, all of Conn.

[73] Assignee: Olin Corporation, New Haven, Conn.

[21] Appl. No.: 920,131

[22] Filed: Jun. 28, 1978

[51] Int. Cl.[2] ..... C22C 9/04

[52] U.S. Cl. ..... 75/157; 75/157.5

[58] Field of Search ..... 75/157, 157.5, 160, 75/154; 148/11.5 C

[56] References Cited

U.S. PATENT DOCUMENTS

| | | | |
|---|---|---|---|
| Re. 19,915 | 4/1936 | Freeman, Jr. | 75/160 |
| 1,040,027 | 10/1912 | Schmid | 75/157 |
| 1,764,571 | 6/1930 | Lytle | 75/157 |
| 2,007,008 | 7/1935 | Staples | 75/160 |
| 2,075,004 | 3/1937 | Bassett | 75/160 |
| 2,133,847 | 10/1938 | Crampton et al. | 75/157 |
| 2,394,673 | 2/1946 | Edmunds | 75/157.5 |
| 3,190,751 | 6/1965 | Blazek | 75/157 |
| 4,014,716 | 3/1977 | Cabo et al. | 148/11.5 C |

FOREIGN PATENT DOCUMENTS

| | | | |
|---|---|---|---|
| 50-78519 | 6/1975 | Japan | 75/157 |
| 27829 | of 1911 | United Kingdom | 75/157 |

*Primary Examiner*—L. Dewayne Rutledge
*Assistant Examiner*—Peter K. Skiff
*Attorney, Agent, or Firm*—Paul Weinstein; Victor A. DiPalma

[57] ABSTRACT

An alloy system which exhibits improved resistance to stress relaxation at elevated temperatures utilizes additions of silicon or tin or mixtures of silicon and tin to a copper-zinc base to attain the stress relaxation performance. The composition and processing of this alloy system maintains at least 90% by weight alpha-phase within the alloy.

8 Claims, No Drawings

MODIFIED BRASS ALLOYS WITH IMPROVED STRESS RELAXATION RESISTANCE

BACKGROUND OF THE INVENTION

Material used for spring connection devices must exhibit the ability to maintain adequate contact pressure for the design life of any part formed from the material. This ability to maintain adequate contact pressure is the ability to resist stress relaxation over a period of time, especially at temperatures elevated above normal room temperature. The current trend in connector design has been to place greater emphasis upon the maintenance of high contact pressure on connector parts at mildly elevated temperatures to reduce problems which might develop as the service temperature of the parts increases. Alloy 260 is currently widely used for electrical connectors but tends to exhibit a rather poor stress relaxation resistance at temperatures of 75° C. or higher. Accordingly, it is important that this widely used alloy be modified in such a manner so as to improve its elevated temperature stress relaxation performance.

It is important to any modifications of Alloy 260 that high conductivity alloy be maintained along with improved stress relaxation performance. Furthermore, bend formability should be maintained while any cost increase in the alloy should be held down as low as possible to keep such an alloy competitive in the market. Other performance characteristics such as stress corrosion, solderability, softening resistance and others should not be significantly degraded below those properties shown by Commercial Alloy 260. It is desirable to the present invention that the performance of such an alloy exhibit approximately a 10–30% increase over projected stress remaining after 100,000 hours at 75° C. or higher relative to Alloy 260. It is also desirable in the present invention that such an alloy maintain approximately a 20% IACS conductivity.

One alloy system which has been developed in the prior art is an improved beta-brass alloy as shown in U.S. Pat. No. 4,055,445 to Horace Pops. This particular patent teaches a brass alloy which exhibits a shape memory effect and which may contain from 25 to 40% by weight zinc along with 0.25 to 3.0% by weight silicon. It should be noted that the only useful alloy system within this broad range is shown by the cross hatched area in FIG. 3 of said patent, wherein the alloy should have a minimum amount of 25% by weight beta-phase up to 75%. Apparently, not only the particular alloy system itself but its specific processing is important in preparing the improved alloy of this particular patent. It is quite important to this patent that an annealing be performed so as to provide the above-mentioned minimum amount of beta-phase material within the alloy system.

It is a principal object of the present invention to provide an alloy system which exhibits improved stress relaxation resistance, particularly at elevated temperatures, when compared to Commercial Alloy 260.

It is a further object of the present invention to provide an alloy system as aforesaid which exhibits improved stress relaxation resistance and maintains approximate conductivity values found in Alloy 260.

It is an additional object of the present invention to provide an alloy system as aforesaid which is essentially an all alpha-phase alloy with up to 10% beta-phase within the alloy.

It is an additional object of the present invention to provide an alloy system as aforesaid which provides the noted benefits without appreciably increasing the cost of such an alloy.

Further objects and advantages will become apparent from a consideration of the following specification.

SUMMARY OF THE INVENTION

The alloy system of the present invention utilizes unique additions of tin or silicon or combinations of tin and silicon to an alpha-brass containing 8 to 34% by weight zinc to provide improvements in the stress relaxation behavior of such an alloy particularly at large degrees of cold reduction. The alloy system of the present invention meets these objectives without appreciably detrimentally affecting the electrical conductivity of the base copper-zinc alloy system. The elemental additions made to the base alloy also provide these increases in performance without appreciably affecting the processing of the alloy system, which contributes to keeping down the cost of such an alloy.

DETAILED DESCRIPTION

The alloy system of the present invention accomplishes its objectives by adding an element selected from the group consisting of 0.05 to 2.0% by weight tin, 0.05 to 3.0% by weight silicon, or any combination thereof, to an alpha-brass containing 8 to 34% by weight zinc. The preferred compositional ranges for these particular additions should range from 0.1 to 2.0% by weight tin and from 0.1 to 2.0% by weight silicon. It should be noted that these additions exhibit an inverse relationship according to the amount of zinc in the alpha-brass base material. In other words, the higher amount of zinc in the base alloy, generally the lower the amount of tin or silicon or silicon plus tin. For example, one addition would contain 30% by weight zinc and 0.4% by weight silicon. The optimum compositional range for this alloy system should be from 20 to 32% by weight zinc and 0.1 to 1.5% by weight silicon, with or without 0.1 to 1.0% by weight tin. The most particular compositional range for this alloy is from 26 to 31% by weight zinc, 0.1 to 1.0% by weight silicon and 0.1 to 1.0% by weight tin, provided that the combined silicon plus tin is at least 0.3% by weight, balance copper.

The elemental additions discussed above maintain an essentially single-phase alpha alloy. It should be stressed that beta-phase formation should be avoided as much as possible. Although immediately after casting and solidification non-equilibrium beta-phase may be present within the alloy system, further processing of the alloy should try to keep the beta-phase to a maximum of 10 wt. percent. In particular, the alloy system of the present invention should not be annealed in an alpha plus beta or a beta-phase region. The presence of the beta-phase adversely affects the cold workability of the alloy as well as its stress corrosion resistance. Various other elements may be added to the alloy of the present invention to suit various purposes. For example, a grain refining element selected from the group consisting of 0.001 to 5.0% by weight iron, 0.001 to 5.0% by weight cobalt, 0.001 to 1.0% by weight chromium, 0.001 to 1.0% by weight zirconium, 0.001 to 1.0% by weight nickel, 0.001 to 1.0% by weight titanium, or any combination thereof may be added to the alloy. Various other elements such as lead may be added to improve the machinability of the alloy and elements such as arsenic may be added to improve the stress corrosion performance of the alloy.

Naturally, the alloy of the present invention may also contain impurities common for alloys of this type and additional additives may be employed in the alloy, as desired, in order to emphasize particular characteristics or to obtain particularly desirable results.

It has normally been expected in this art that an increase in the yield strength of such an alloy should provide an improvement in the stress relaxation performance of the alloy. The improvements brought about by the alloy system of the present invention are considerably greater than those improvements which can be realized by increasing the yield stress alone. These modifications made in the present invention do raise the yield strength of Alloy 260 brass by as much as 13% while they raise the stress remaining values of the alloy by as much as 30%. It is this unexpected increase in the stress remaining value of the alloy system which provides the surprising benefits of the present invention.

The processing of the alloys of the present invention includes various stages of hot and cold working along with various annealing stages. The hot working of this alloy system should be done at a minimum temperature which is above the recrystallization temperature of the particular alloy being worked and which is below the solidus temperature of the alloy. This temperature will range between 500° and 1000° C. or preferably between 600° and 900° C. An optional step after hot working in the processing can be a diffusion annealing step. This annealing will utilize a temperature range of from 200° to 800° C. for 1 to 24 hours or preferably a range of 400° to 700° C. for 1 to 12 hours. The alloy can then be subjected to a milling step, whether or not it undergoes the annealing step, in order to clean the surface of the worked alloy and prepare it for further working. The alloy may then be cold worked with up to but not including a 100% reduction in area and preferably a 10 to 98% reduction in cross-sectional area. The cold worked material can then be subjected to an annealing step at 150° to 900° C. for enough time to recrystallize the alloy to a grain size of 0.005 to 0.05 mm. This annealing can be accomplished in cycles with cold working steps provided that cold working is that last step of the cycle. Cleaning of the worked material can be performed after any one of the annealing steps and not necessarily after each annealing step.

The present invention will be more readily understood from a consideration of the following illustrative examples.

EXAMPLE I

Alloys of the present invention were all made by adding the elemental additions to molten copper at approximately 1100° C. The zinc was added at approximately 1050° C. and all ingots were poured at 950° to 1050° C. These ingots were then soaked at 800° C. for 2 hours prior to hot working by rolling down to a 0.48" gage and then both rolled surfaces were milled to a final gage of 0.4". Subsequent processing consisted of cold working up to a 90% reduction with interanneals of 550° C. for one hour in air between each cold working pass. The material utilized in this processing was given a final anneal such that the grain size of the alloy was approximately 0.010 mm.

Various alloys were cast in air as 10 lb. ingots with the compositions in weight percent as shown in Table I. Four control alloys of copper-30% zinc were cast and the average properties of the four controls were utilized at subsequent measurements. An additional alloy of commercial processed copper-30% zinc brass was also utilized. The appropriate amounts of the required elements were added to molten copper and the melts were poured through a tundish into a chilled mold. The processing of the alloys consisted of soaking at 800° C. for 2 hours followed by hot rolling to 0.48" and surface milling down to 0.4". The alloys were subsequently cold rolled with intermediate annealing. This annealing was utilized to provide a grain size in the alloy prior to a final cold reduction of 0.01 mm. The final cold rolling reductions were either 35% or 60%, which values were selected for property measurement at each point.

Samples were machined from the 0.03" final gage material after cold working and were tested for their stress relaxation behavior in the longitudinal direction at 75° C. Initial loading was set at 80% of the 0.2% offset yield stress for each alloy. Data for percent stress remaining at 1,000 or more hours of testing were extrapolated to 100,000 hours. The logarithm of stress remaining versus the logarithm of time and hours was assumed to be a linear relationship. The results are presented in Table II.

TABLE I

NOMINAL COMPOSITIONS OF ALLOYS

| Alloy No. | Composition % Zn | % Si | % Sn | % Cu |
|---|---|---|---|---|
| Control | 30 | — | — | Rem. |
| Commercial Alloy 260 | 30 | — | — | Rem. |
| C246 | 20 | 0.8 | — | Rem. |
| C247 | 27 | 0.4 | — | Rem. |
| C253 | 27 | 0.4 | — | Rem. |
| C167 | 27 | 0.8 | — | Rem. |
| A947 | 30 | — | 0.15 | Rem. |
| A948 | 30 | — | 0.5 | Rem. |
| C248 | 27 | 0.4 | 0.5 | Rem. |
| C311 | 27 | 0.3 | 0.4 | Rem. |
| C312 | 27 | 0.4 | 0.3 | Rem. |
| C313 | 27 | 0.5 | 0.2 | Rem. |
| C314 | 27 | 0.6 | 0.1 | Rem. |

TABLE II

ALLOY PROPERTIES

| Alloy | % CW | 0.2% YS | UTS | % Elong. | MBR (in 1/64")* | Initial Stress | Stress Relaxation Behavior: Actual 1,000 H. % Stress Remaining | Extrapolated 100,000 H. % Stress Remaining | Extrapolated 100,000 H. Stress Remaining |
|---|---|---|---|---|---|---|---|---|---|
| Control | 35 | 71.4 | 79.7 | 7.7 | 4 | 57.1 | 76.8 | 66.9 | 38.2 |
| | 60 | 86.1 | 99.6 | 2.8 | 16 | 68.9 | 70.4 | 59.4 | 40.9 |
| Commercial Alloy 260 | 60 | 85.8 | 102.0 | 2.5 | N.A. | 68.6 | 68.1 | 56.9 | 39.0 |
| C246 | 35 | 77.5 | 91.8 | 8.0 | 4 | 62.0 | 83.4 | 79.4 | 49.2 |
| | 60 | 88.7 | 108.2 | 2.5 | 16 | 70.9 | 82.0 | 75.8 | 53.7 |
| C247 | 35 | 75.8 | 88.7 | 6.5 | 4 | 60.6 | 82.6 | 76.7 | 46.5 |
| | 60 | 87.6 | 105.5 | 2.5 | 16 | 70.1 | 75.5 | 66.9 | 46.9 |
| C253 | 35 | 78.5 | 90.7 | 6.0 | 4 | 62.8 | 82.4 | 75.7 | 47.5 |

TABLE II-continued

| Alloy | % CW | 0.2% YS | UTS | % Elong. | MBR (in 1/64")* | Initial Stress | Stress Relaxation Behavior: Actual 1,000 H. % Stress Remaining | Extrapolated 100,000 H. % Stress Remaining | Extrapolated 100,000 H. Stress Remaining |
|---|---|---|---|---|---|---|---|---|---|
| | 60 | 90.9 | 106.0 | 2.0** | 16 | 72.7 | 74.9 | 66.2 | 48.1 |
| C167 | 35 | 77.0 | 88.0 | 9.0 | 3 | 61.6 | 84.4 | 77.5 | 47.7 |
| | 60 | 92.7 | 109.4 | 2.5 | 16 | 74.1 | 82.4 | 72.0 | 53.4 |
| A947 | 35 | 72.4 | 78.8 | 5.5 | N.A. | 57.9 | 81.4 | 71.2 | 41.2 |
| | 60 | 89.9 | 101.4 | 1.5 | N.A. | 71.9 | 73.7 | 61.2 | 44.0 |
| A948 | 35 | 77.5 | 84.1 | 4.5 | 4 | 62.0 | 82.8 | 73.4 | 45.0 |
| | 60 | 93.3 | 102.7 | 1.5 | 20 | 74.6 | 75.4 | 62.9 | 46.9 |
| C248 | 35 | 80.9 | 91.5 | 6.0 | 4 | 64.7 | 84.4 | 79.0 | 51.1 |
| | 60 | 93.2 | 109.5 | 1.0** | 20 | 74.6 | 77.3 | 69.3 | 51.7 |
| C311 | 35 | 81.9 | 90.3 | 6.1 | 5 | 65.5 | 82.0 | 75.1 | 49.2 |
| | 60 | 95.4 | 108.1 | 2.9 | 16 | 76.3 | 75.2 | 65.0 | 49.6 |
| C312 | 35 | 81.8 | 91.2 | 6.8 | 4 | 65.4 | 82.7 | 76.6 | 50.1 |
| | 60 | 93.1 | 107.0 | 2.4 | 16 | 74.5 | 77.0 | 66.9 | 49.8 |
| C313 | 35 | 83.2 | 92.8 | 7.5 | 4 | 66.6 | 85.2 | 79.6 | 53.0 |
| | 60 | 98.9 | 108.1 | 2.8 | 16 | 79.1 | 75.9 | 65.9 | 52.1 |
| C314 | 35 | 83.3 | 93.5 | 6.7 | 4 | 66.6 | 83.4 | 77.0 | 51.3 |
| | 60 | 96.1 | 108.6 | 2.8 | 16 | 76.9 | 76.3 | 66.7 | 51.3 |

*In transverse direction
**Broke outside gage marks
N.A. - Not Available
YS, UTS, Initial Stress and Stress Remaining values are all in ksi.

As can be seen from Table II, the alloys according to the present invention exhibit surprising stress relaxation resistance behavior when compared to either Commercial Alloy 260 or a similar laboratory manufactured material. The Stress Remaining portion of Table II extrapolated to 100,000 hours indicates that the benefits derived from the present invention are more than can be expected from a simple increase in yield strength compared to the base alloys. For example, while the yield strength of Alloy C247, the composition of which falls within the present invention, is only 4.4 ksi and 1.5 ksi at 35% cold worked and 60% cold worked greater than the Control Alloy, the Stress Remaining at 100,000 Hours is 8.3 and 6.0 ksi greater at these cold working reductions than the Control Alloy. This clearly demonstrates the unexpected and surprising improvement in stress relaxation resistance brought about by the alloys of the present invention.

EXAMPLE II

The alloys listed in Table I were processed as described in Example I and the Stress Remaining after 100,000 Hours was determined based on Initial Stress levels of 60 and 70 ksi corresponding to hard temper brass and spring temper brass, respectively. The percentage difference over the average Cu-30% Zn base alloy was also measured. The results are shown in Table III.

Electrical conductivities for each of these alloys were measured in various degrees of worked and annealed conditions. These results are shown in Table IV.

TABLE III

STRESS REMAINING AFTER 100,000 HOURS AND IMPROVEMENT OVER BRASS CONTROLS BASED ON INITIAL STRESS LEVELS OF 60 AND 70 KSI

| Alloy No. | Nominal Composition | 60 ksi Initial Stress: % SR | 100,000 H. SR | % Difference Over Average Cu-30 Zn | 0 ksi Initial Stress: % SR | 100,000 H. SR | % Difference Over Average Cu-30 Zn |
|---|---|---|---|---|---|---|---|
| Average of Cu-30 Zn Controls | Cu-30 Zn | 65.4 | 39.2 | — | 60.0 | 42.0 | — |
| C246 | Cu-20 Zn-0.8 Si | 80.2 | 48.1 | +23 | 76.2 | 53.3 | +27 |
| C247 | Cu-27 Zn-0.4 Si | 77.3 | 46.4 | +18 | 67.0 | 46.9 | +12 |
| C253 | Cu-27 Zn-0.4 Si | 78.4 | 47.0 | +20 | 68.8 | 48.2 | +15 |
| C167 | Cu-27 Zn-0.8 Si | 78.2 | 46.9 | +20 | 73.8 | 51.7 | +23 |
| A947 | Cu-30 Zn-0.15 Sn | 69.7 | 41.8 | +7 | 62.6 | 43.8 | +4 |
| A948 | Cu-30 Zn-0.5 Sn | 75.1 | 45.0 | +15 | 66.7 | 46.7 | +11 |
| C248 | Cu-27 Zn-0.4 Si-0.5 Sn | 83.6 | 50.2 | +28 | 73.8 | 51.7 | +23 |
| C311 | Cu-27 Zn-0.3 Si-0.4 Sn | 80.2 | 48.1 | +23 | 70.9 | 49.6 | +18 |
| C312 | Cu-27 Zn-0.4 Si-0.3 Sn | 82.4 | 49.4 | +26 | 71.7 | 50.2 | +20 |
| C313 | Cu-27 Zn-0.5 Si-0.2 Sn | 86.8 | 52.1 | +33 | 75.9 | 53.1 | +27 |
| C314 | Cu-27 Zn-0.6 Si-0.1 Sn | 83.6 | 50.2 | +28 | 73.6 | 51.5 | +23 |

TABLE IV

CONDUCTIVITY PROPERTIES*

| Alloy No. | Condition | Conductivity (% IACS) |
|---|---|---|
| Control | 35% CW | 26.0 |
| C246 | Annealed | 18.3 |
| C247 | Annealed | 21.9 |
| C253 | Annealed | 22.0 |
| C167 | Annealed | 18.7 |
| A947 | 35% CW | 26.3 |
| A948 | 35% CW | 25.1 |
| C248 | Annealed | 21.1 |
| C311 | 60% CW | 20.5 |
| C312 | Annealed | 21.7 |
| C313 | 60% CW | 18.5 |

TABLE IV-continued

| CONDUCTIVITY PROPERTIES* | | |
|---|---|---|
| Alloy No. | Condition | Conductivity (% IACS) |
| C314 | Annealed | 19.4 |

It can readily be seen from Table III that the silicon or tin additions to the copper-zinc base provide significant improvements in the stress remaining values over the average of the copper-30 zinc controls. It is quite apparent from Table III that the improvements brought about by the silicon and tin additions appear to be concentration dependent in that the percentage difference over the average control values increases as the percentage of silicon and tin increases in the base alloy. It can further be seen from Table III that it is the combination of silicon and tin which provides the greatest consistent improvement in stress relaxation performance throughout the specified alloys at a given level of conductivity. This improvement brought about by the combination of silicon and tin appears to be a result of a synergistic combination of these two elements since it would be expected from the silicon and tin results alone that a lower amount of improvement would result from a combination of these elements. For example, Alloy C247 at 60 ksi initial stress exhibits an 18% improvement over the control alloy values. Alloy A948 exhibits a 15% improvement at the same initial stress value. Alloy C248, which contains a mixture of the same amounts of silicon and tin found in Alloys C247 and A948, respectively, exhibits a 28% improvement over the control values at the same initial stress. It would not be expected that simply adding these two elements together in a copper-zinc base would provide such a large improvement.

It should be noted from Table IV that in most instances the addition of silicon or a mixture of silicon plus tin to a copper-zinc base reduces the electrical conductivity somewhat when compared to the control material. There appears to be a trade off point between desired conductivity and desired resistance to stress relaxation. The large percentage improvements demonstrated by the silicon and silicon plus tin additions to the base alloy in Table III offset somewhat the relatively small decrease in conductivity exhibited by these same alloys in Table IV. It can be seen, therefore, that the most preferred embodiment for the alloys of the present invention would be an alloy system which contains both silicon and tin. Such a combination would provide the desired stress relaxation performance benefits without greatly reducing the conductivity values also desired in such an alloy.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An essentially single-phase alpha alloy which is hot workable and which is particularly resistant to stress relaxation at elevated temperatures, said alloy consisting essentially of 0.05 to 2% by weight tin and 0.05 to 3% by weight silicon, provided that the combined silicon plus tin content of the alloy is at least 0.3% by weight, from 20 to 34% by weight zinc, balance copper.

2. An alloy as in claim 1 wherein said alloy has good bend formability.

3. An alloy according to claim 1, wherein said element is selected from the group consisting of 0.1 to 2.0% by weight tin and 0.1 to 2.0% by weight silicon, or any combination thereof, provided that any combined silicon plus tin is at least 0.3% by weight of the alloy.

4. An alloy according to claim 1, wherein said alloy consists essentially of an element selected from the group consisting of 0.1 to 1.0% by weight tin, 0.1 to 1.5% by weight silicon, or any combination thereof, provided that any combined silicon plus tin is at least 0.3% by weight, from 20 to 32% by weight zinc, balance copper.

5. An alloy according to claim 1, wherein said alloy consists essentially of an element selected from the group consisting of 0.1 to 1.0% by weight for each of silicon and tin, or any combination thereof, provided that any silicon plus tin is at least 0.3% by weight, from 26 to 31% by weight zinc, balance copper.

6. An alloy according to claim 1, wherein said alpha-phase within the alloy accounts for at least 90% by weight of the alloy.

7. An alloy according to claim 1, wherein said alloy is in the worked condition and has a grain size of approximately 0.005 to 0.050 mm.

8. An essentially single-phase alpha alloy which is hot workable and which is particularly resistant to stress relaxation at elevated temperatures, said alloy consisting essentially of 0.05 to 2.0% by weight tin, from 26 to 34% by weight zinc, balance copper.

* * * * *